US005826283A

United States Patent [19]

Edwards

[11] Patent Number: 5,826,283

[45] Date of Patent: Oct. 27, 1998

[54] LIFE SAFETY DEVICE

[76] Inventor: Mark J. Edwards, 221 Sygan Rd., McDonald, Pa. 15057

[21] Appl. No.: 857,875

[22] Filed: May 16, 1997

[51] Int. Cl.[6] ..... E04H 4/10

[52] U.S. Cl. ..... 4/503; 4/498

[58] Field of Search ..... 4/498, 506, 503

[56] References Cited

U.S. PATENT DOCUMENTS 3,355,745 12/1967 Jannuzzi ..... 4/503

*Primary Examiner*—Robert M. Fetsuga

[57] ABSTRACT

A life safety device is provided including a pool having an upper exterior edge. A cover is provided having a continuous sleeve formed about a periphery thereof. Also included is a belt situated within the continuous sleeve of the cover for precluding the removal of the cover from the pool.

1 Claim, 2 Drawing Sheets

10

22
24
12
16
38
32
14

3

24
4
4
30
3
34
60
64
50
38
42
32
36
26
28

LIFE SAFETY DEVICE

BACKGROUND OF THE INVENTION

1. Field of the Invention

The present invention relates to a life safety device and more particularly pertains to preventing a person from falling within a pool.

2. Description of the Prior Art

The use of pool covers is known in the prior art. More specifically, pool covers heretofore devised and utilized for the purpose of preventing debris from entering a pool are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. Nos. 3,287,740; Re. 30,774; 3,391,410; 3,287,740; 2,958,872; and 3,229,309.

In this respect, the life safety device according to the present invention substantially departs from the conventional concepts and designs of the prior art, and in so doing provides an apparatus primarily developed for the purpose of preventing a person from falling within a pool.

Therefore, it can be appreciated that there exists a continuing need for a new and improved life safety device which can be used for preventing a person from falling within a pool. In this regard, the present invention substantially fulfills this need.

SUMMARY OF THE INVENTION

In view of the foregoing disadvantages inherent in the known types of pool covers now present in the prior art, the present invention provides an improved life safety device. As such, the general purpose of the present invention, which will be described subsequently in greater detail, is to provide a new and improved life safety device which has all the advantages of the prior art and none of the disadvantages.

To attain this, the present invention essentially comprises a pool. As shown in FIG. 1, the pool has a circular bottom with a cylindrical periphery integrally coupled thereto and extending upwardly therefrom. The pool thus defines an open circular top and an interior space for containing water therein. As shown in FIG. 3, the periphery includes an upper exterior edge having an annular protrusion integrally formed therewith and extending radially outwardly therefrom. As shown in FIGS. 1 & 3, a circular cover is provided having a continuous skirt integrally coupled about an entire periphery thereof. The cover is adapted to be disposed about the open top of the pool such that the skirt depends downwardly over the protrusion of the exterior edge thereof. As best shown in FIG. 3, the skirt has an interior layer and an exterior layer defining a continuous sleeve. The skirt further includes a pair of spaced slots formed in the exterior layer thereof. It should be noted that the cover is constructed from woven nylon threads and are inextensible, flexible and water permeable. The woven threads of the cover further have a rubber coating formed on a top and a bottom thereof. Further included is an inextensible, flexible belt situated within the sleeve of the cover. Preferably, the belt is positioned below the protrusion of the periphery of the pool. The belt further includes a first end and a second end extending through a respective one of slots of the sleeve. With reference now to FIGS. 2 & 4, a winch is provided having a rectilinear configuration with a top face, a bottom face, a rear face, a front face, and a pair of open ends defining an interior space. The rear face has a vertical slot formed therein adjacent a first one of the open ends. Such slot is adapted for allowing the coupling of the first end of the belt thereto. The winch further has a ratchet winding assembly. The ratchet winding assembly includes a spool rotatably coupled about a vertical axis within the interior space adjacent a second one of the open ends of the winch. The spool is equipped with a plurality of teeth formed therein. A first pawl is situated within the interior space of the winch and pivotally coupled to the bottom face thereof. By this positioning, the pawl is adapted for engaging the teeth of the spool and only allowing the rotation thereof in a first direction of rotation. Further included is a lever ratchet arm. As best shown in FIG. 4, the lever ratchet arm has a planar member with a clevis coupled to a first end thereof. The clevis is rotatably coupled to the top face and bottom face of the winch about the vertical axis of the spool. As such, the clevis is rotatable with respect to the spool. The ratchet winding assembly has a second pawl pivotally coupled to the clevis for engaging the teeth of the spool thereby effecting the rotation of the spool only in the first direction of rotation upon the reciprocation of the lever ratchet arm. Such reciprocation is effected between a first orientation with the planar member abutting the front face of the winch and a second orientation with the planar member extending outwardly therefrom. In use, the second end of the belt is wrappedly coupled about the spool such that the belt tightens about the periphery of the pool when the spool is rotated in the first direction. As such, the tightening of the belt precludes the removal of the cover from the pool.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved life safety device which has all the advantages of the prior art pool covers and none of the disadvantages.

It is another object of the present invention to provide a new and improved life safety device which may be easily and efficiently manufactured and marketed.

It is a further object of the present invention to provide a new and improved life safety device which is of a durable and reliable construction.

An even further object of the present invention is to provide a new and improved life safety device which is susceptible of a low cost of manufacture with regard to both materials and labor, and which accordingly is then susceptible of low prices of sale to the consuming public, thereby making such life safety device economically available to the buying public.

Still yet another object of the present invention is to provide a new and improved life safety device which provides in the apparatuses and methods of the prior art some of the advantages thereof, while simultaneously overcoming some of the disadvantages normally associated therewith.

Still another object of the present invention is to preventing a person from falling within a pool.

Lastly, it is an object of the present invention to provide a new and improved life safety device including a pool having an upper exterior edge. A cover is provided having a continuous sleeve formed about a periphery thereof. Also included is a belt situated within the continuous sleeve of the cover for precluding the removal of the cover from the pool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
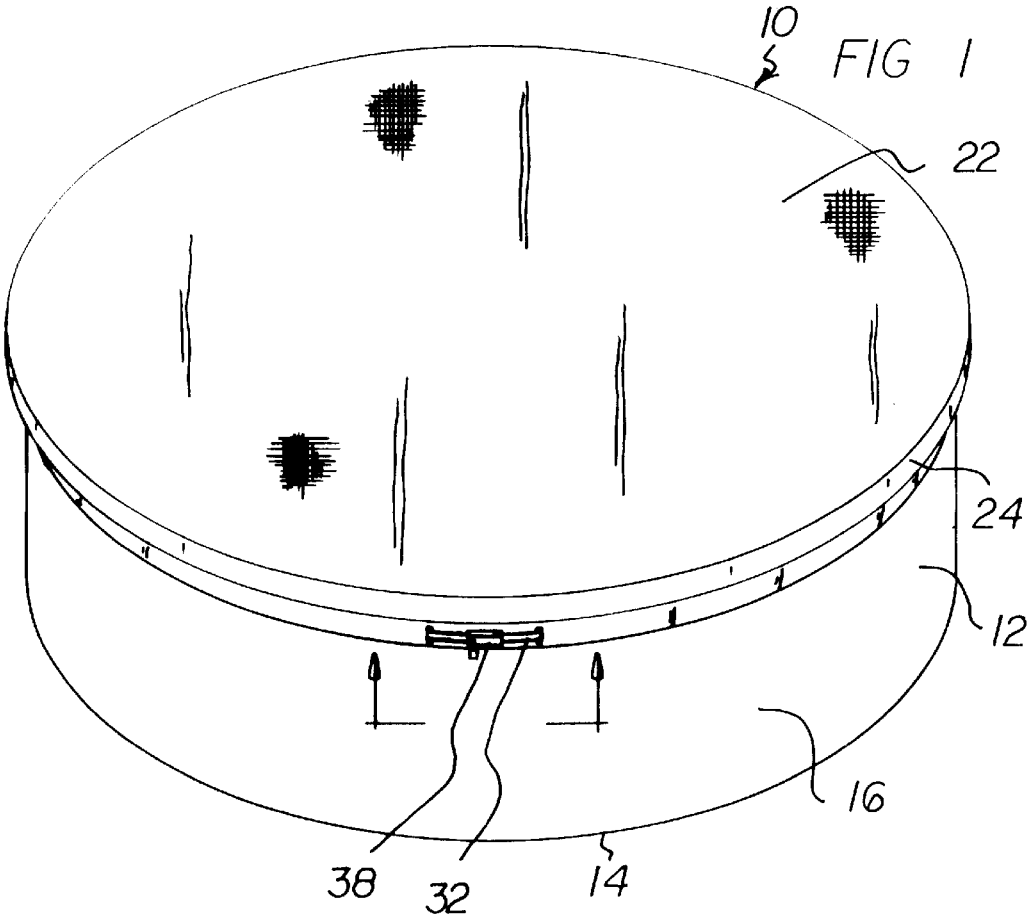
FIG. 1 is a perspective illustration of the preferred embodiment of the life safety device constructed in accordance with the principles of the present invention.

With reference now to the drawings, and in particular to FIG. 1 thereof, a new and improved life safety device embodying the principles and concepts of the present invention and generally designated by the reference numeral 10 will be described.

The present invention, the new and improved life safety device, is comprised of a plurality of components. Such components in their broadest context include a cover, belt, and winch. Such components are individually configured and correlated with respect to each other so as to attain the desired objective.

Figure 3:
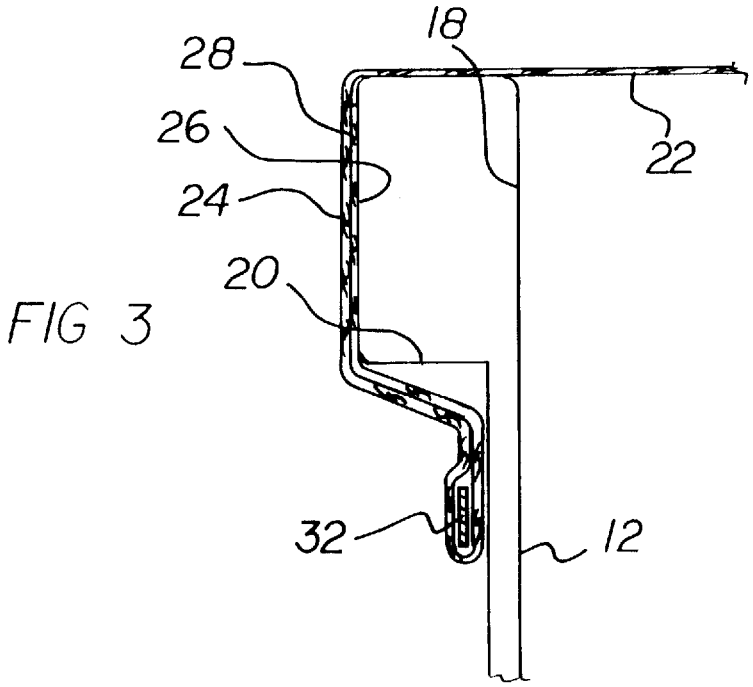
FIG. 3 is a cross-sectional view taken along line 3—3 shown in FIG. 2 showing the sleeve and belt of the present invention.

More specifically, it will be noted that the system 10 of the present invention includes a pool 12. As shown in FIG. 1, the pool has a circular bottom 14 with a cylindrical periphery 16 integrally coupled thereto and extending upwardly therefrom. The pool thus defines an open circular top and an interior space for containing water therein. As shown in FIG. 3, the periphery includes an upper exterior edge 18 having an annular protrusion 20 integrally formed therewith and extending radially outwardly therefrom. Such annular protrusion preferably has a rectangular cross-section. It should be noted that the present invention may be utilized with any pool having an upper peripheral lip.

As shown in FIGS. 1 & 3, a circular cover 22 is provided having a continuous skirt 24 integrally coupled about an entire periphery thereof. The cover is adapted to be disposed about the open top of the pool such that the skirt depends downwardly over the protrusion of the exterior edge thereof. As best shown in FIG. 3, the skirt has an interior layer 26 and an exterior layer 28 defining a fully enclosed continuous sleeve. As shown in FIG. 3, the exterior layer is integral with the cover and the interior layer is integral with the exterior layer at a lower edge and stitchedly coupled to the exterior layer at an upper edge thereof. The skirt further includes a pair of spaced slots 30 formed in the exterior layer thereof. Such slots have a height of between 2½ and 3½ inches or preferably 3 inches and are spaced no more than 1 and ½ feet apart. In the preferred embodiment, the cover has a diameter of about 10 feet and the sleeve has a height of approximately 6 inches.

It should be noted that the cover is constructed from woven nylon threads and are inextensible, flexible and water permeable. The woven threads of the cover further have a rubber coating formed on a top and a bottom thereof. The cover is thus constructed from a material similar to that utilized in the art of trampolines.

Further included is an inextensible, flexible belt 32 situated within the sleeve of the cover. Preferably, the belt is positioned below the protrusion of the periphery of the pool. The belt further includes a first end 34 and a second end 36 extending through a respective one of slots of the sleeve. Ideally, the belt has a thickness of between about ¾ and 1¼ inches. Preferably, the thickness of the belt is 1 inch.

Figure 2:
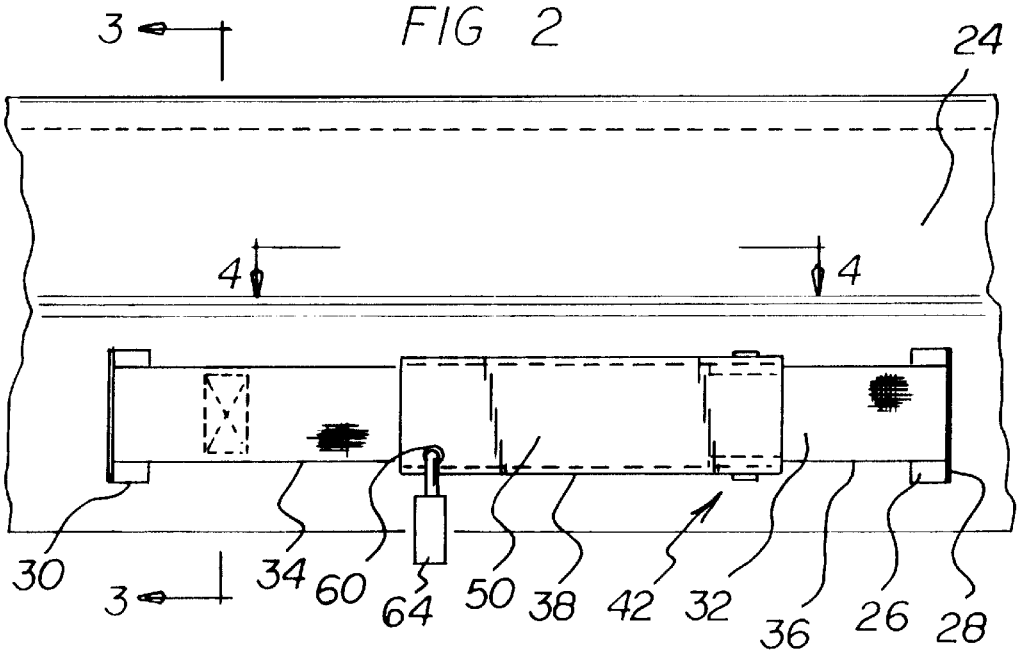
FIG. 2 is a side view of the winch of the present invention.
Figure 4:
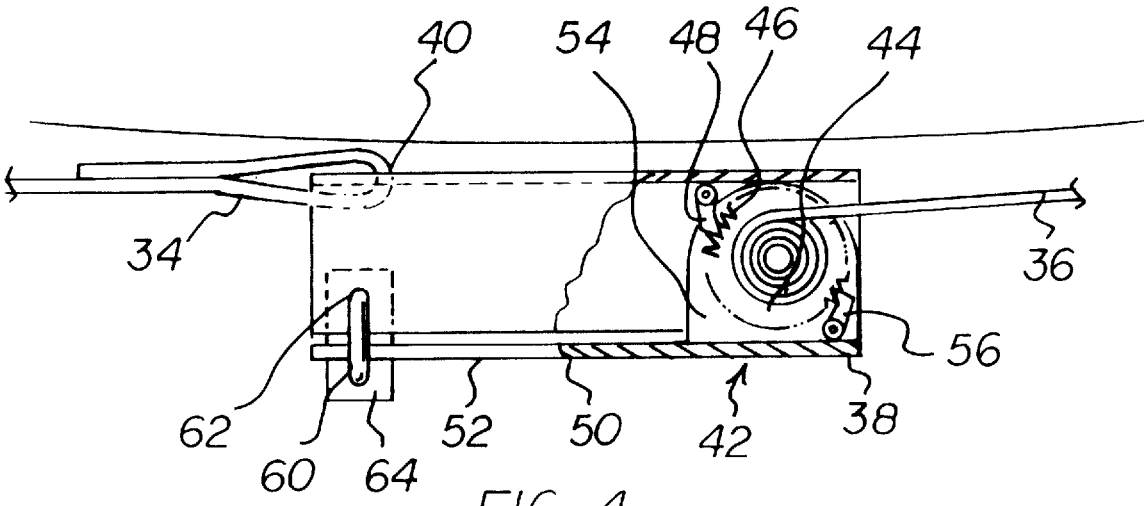
FIG. 4 is a sectional view taken along line 4—4 shown in FIG. 2 showing the winch and associated ratchet winding assembly of the present invention.

With reference now to FIGS. 2 & 4, a winch 38 is provided having a rectilinear configuration with a top face, a bottom face, a rear face, a front face, and a pair of open ends defining an interior space. The rear face has a vertical slot 40 formed therein adjacent a first one of the open ends. Such slot is adapted for allowing the coupling of the first end of the belt thereto by way of a closed loop. The winch further has a ratchet winding assembly 42. The ratchet winding assembly includes a spool 44 rotatably coupled about a vertical axis within the interior space adjacent a second one of the open ends of the winch. The spool is equipped with a lower disk having a plurality of teeth 46 formed in a periphery thereof. A first pawl 48 is situated within the interior space of the winch and pivotally coupled to the bottom face thereof. By this positioning, the pawl is adapted for engaging the teeth of the spool and only allowing the rotation thereof in a first direction of rotation. To accomplish this, the pawl is spring biased in engagement with the teeth at an angle.

Further included is a lever ratchet arm 50. As best shown in FIG. 4, the lever ratchet arm has a planar member 52 with a clevis 54 coupled to a first end thereof. The clevis is rotatably coupled to the top face and bottom face of the winch about the vertical axis of the spool. It is necessary that the clevis be coupled within the interior space of the winch and a cut out be formed in the front face thereof for allowing the same. Further, it is imperative that the clevis be rotatable with respect to the spool and not interfere with the first pawl. The ratchet winding assembly has a second pawl 56 pivotally coupled to the clevis for engaging the teeth of the spool thereby effecting the rotation of the spool only in the first direction of rotation upon the reciprocation of the lever ratchet arm. Such reciprocation is effected between a first orientation with the planar member abutting the front face of the winch and a second orientation with the planar member extending outwardly therefrom.

As an option, an aperture 60 may be formed in the planar member of the ratchet winding assembly and further a pair of apertures 62 formed in the top and front face of the winch. Such apertures allow the removable coupling of a lock 64 therethrough. Such lock maintains the planar member of the ratchet winding assembly in the first orientation thereof thereby precluding access to the interior space of the winch and rotation of the spool.

In use, the second end of the belt is wrappedly coupled about the spool such that the belt tightens about the periphery of the pool when the spool is rotated in the first direction. As such, the tightening of the belt precludes the removal of the cover from the pool. As an option, a water impermeable tarp may be situated over the cover to further prevent the infiltration of water, particles and the like. To allow loosening of the belt and subsequent removal of the cover, the cut out of the front face of the winch is preferably large enough for allowing access to the first pawl for manually disengaging it from the teeth. Further, it should be understood that the second pawl may be manually disengaged at any time via the open end of the winch.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A life safety device comprising, in combination:

a pool having a circular bottom with a cylindrical periphery integrally coupled thereto and extending upwardly therefrom defining an interior space for containing water therein and an open circular top, the periphery having an upper exterior edge having an annular protrusion integrally formed therewith and extending radially outwardly therefrom;

a circular cover having a continuous skirt integrally coupled about an entire periphery thereof, wherein the cover is adapted to be disposed about the open top of the pool such that the skirt depends downwardly over the protrusion of the exterior edge thereof, the skirt having an interior layer and an exterior layer defining a continuous sleeve, wherein the interior layer is integral with the exterior layer at a lower edge and stitchedly coupled to the exterior layer at an upper edge, the skirt further including a pair of spaced slots formed in the exterior layer thereof;

said cover being constructed from woven nylon threads and being inextensible, flexible and water permeable, the cover further having a rubber coating formed on a top and a bottom thereof;

an inextensible, flexible belt situated within the sleeve of the cover and below the protrusion of the periphery of the pool, the belt further including a first end and a second end extending through a respective one of the slots of the sleeve;

a winch having a rectilinear configuration with a top face, a bottom face, a rear face, a front face, and a pair of open ends defining an interior space, the rear face having a vertical slot formed therein adjacent a first one of the open ends for allowing the coupling of the first end of the belt thereto, the winch including a ratchet winding assembly having a spool rotatably coupled about a vertical axis within the interior space adjacent a second one of the open ends of the winch, the spool having a plurality of teeth formed in a lower disk thereof, a spring biased first pawl situated within the interior space and pivotally coupled to the bottom face of the winch for engaging the teeth of the spool and only allowing the rotation thereof in a first direction of rotation, and a lever ratchet arm, the lever ratchet arm having a planar member with a clevis coupled to a first end thereof, the clevis rotatably coupled to the top face and bottom face of the winch about the vertical axis of the spool wherein the clevis is rotatable with respect to the spool, the clevis having a second pawl pivotally coupled thereto for engaging the teeth of the spool for effecting the rotation of the spool only in the first direction of rotation upon the reciprocation of the lever ratchet arm between a first orientation with the planar member abutting the front face of the winch and a second orientation with the planar member extending outwardly therefrom;

whereby the second end of the belt is wrappedly coupled about the spool such that the belt tightens about the periphery of the pool when the spool is rotated in the first direction, wherein the tightening of the belt precludes the removal of the cover from the pool;

a plurality of apertures including a first aperture formed in the planar member of the lever ratchet arm of the ratchet winding assembly, a second aperture formed in the top face of the winch, and a third aperture formed in the front face of the winch; and a lock for releasably engaging the apertures for precluding the reciprocation of the planar member of the lever ratchet arm of the ratchet winding assembly.

* * * * *